US005182927A

United States Patent [19]

Pernick

[11] Patent Number: 5,182,927

[45] Date of Patent: Feb. 2, 1993

[54] CAM SYSTEM FOR CIRCULAR KNITTING MACHINE

[75] Inventor: David Pernick, Glendale, N.Y.

[73] Assignee: Monarch Knitting Machinery Corporation, Glendale, N.Y.

[21] Appl. No.: 737,383

[22] Filed: Jul. 29, 1991

Related U.S. Application Data

[63] Continuation-in-part of Ser. No. 674,212, Mar. 25, 1991.

[51] Int. Cl.[5] ..... D04B 9/06

[52] U.S. Cl. ..... 66/54; 66/27

[58] Field of Search ..... 66/27, 54, 57, 20, 51

[56] References Cited

U.S. PATENT DOCUMENTS

| | | | |
|---|---|---|---|
| 1,147,730 | 7/1915 | Ingalls . | |
| 2,681,553 | 6/1954 | Chiti . | |
| 2,775,107 | 12/1956 | Shortland | 66/27 |
| 3,456,460 | 7/1969 | Mishcon | 66/20 |
| 3,513,666 | 5/1970 | Mishcon | 66/54 |
| 4,178,779 | 12/1979 | Schreiner | 66/54 |
| 4,996,853 | 3/1991 | Brega | 66/27 |

FOREIGN PATENT DOCUMENTS

| | | | |
|---|---|---|---|
| 2636020 | 2/1978 | Fed. Rep. of Germany | 66/57 |
| 2856602 | 7/1980 | Fed. Rep. of Germany | 66/54 |
| 3229342 | 2/1983 | Fed. Rep. of Germany | 66/54 |
| 1076196 | 10/1954 | France | 66/54 |

*Primary Examiner*—Andrew M. Falik
*Assistant Examiner*—John J. Calvert
*Attorney, Agent, or Firm*—Bell, Seltzer, Park & Gibson

[57] ABSTRACT

A circular knitting machine with needles having operating butts of predetermined height includes a stitch cam unit for raising and lowering the needles by engaging the operating butts. The cam system includes a support body and a needle raising cam block having upper and lower cam members fixed to the support body and having corresponding upwardly inclined lower and upper butt engaging surfaces which are spaced from each other a distance substantially corresponding to the dimensions of the predetermined height of the needle butts. The upper cam member also includes a downwardly inclined lower butt engaging surface extending from the top portion of the upwardly inclined lower butt engaging surface for engagement with the needle butts. A stitch cam member has a downwardly inclined lower butt engaging surface cooperating with the downwardly inclined lower butt engaging surface of the needle raising cam. A lower landing cam member has an upper butt engaging surface spaced from the lower butt engaging surface a distance substantially corresponding to the dimensions of the predetermined height of the needle butts to define a closed track herebetween. The stitch cam member and lower landing cam member are movable along an inclined angle relative to the upper and lower cam members for obliquely moving together the upper stitch cam member and the lower landing cam member to the change the stitch forming level of the needles. The cooperating surfaces of the lower butt engaging surface ensure that the upper and lower butt engaging surfaces forming the downwardly inclined closed track remain substantially parallel when the stitch forming level is changed.

14 Claims, 2 Drawing Sheets

CAM SYSTEM FOR CIRCULAR KNITTING MACHINE

This application is a continuation-in-part application of patent application Ser. No. 07/674,212, filed Mar. 25, 1991.

FIELD OF THE INVENTION

This invention relates to a circular knitting machine with needles having operating butts of a predetermined height and a stitch cam unit with a closed track for closely confining the operating butts and accurately raising and lowering the needles.

BACKGROUND OF THE INVENTION

In the parent application, a circular knitting machine is disclosed in which a stitch cam is supported for movable adjustment along an inclined angle relative to the needle raising cam for obliquely moving together an upper stitch cam member and a lower landing cam member to change the stitch forming level of the needles. Upper and lower needle raising cam members are integrally formed on a needle raising mounting block and have correspondingly upwardly inclined lower and upper butt engaging surfaces that are spaced from each other a distance substantially corresponding to the dimensions of the predetermined height of the needle butts to define an upwardly inclined closed track.

A stitch cam mounting block includes an upper stitch cam member and lower landing cam member having respective downwardly inclined lower and upper butt engaging surfaces being spaced from each other a distance substantially corresponding to the dimensions of the predetermined height of the needle butts to define a downwardly inclined closed track therebetween. The upwardly and downwardly inclined closed tracks form a triangular configuration when viewed in cross section.

In the illustrated embodiment of the parent application, the lower cam member also includes a downwardly inclined upper butt engaging surface extending from the top portion of the upwardly inclined upper butt engaging surface. This downwardly inclined surface cooperates with the lower landing cam member. The upper butt engaging surface of the lower landing cam member includes a front notch and the downwardly inclined upper butt engaging surface of the lower cam member includes a rear notch cooperating with the upper butt engaging surface for providing a continual butt engaging surface when the lower landing cam member is moved obliquely. The cooperating surfaces form a smooth transition for the lower surfaces of the needle butts when the stitch cam member is adjusted to change the stitch forming level of the needles.

At the apex of the formed triangle of the closed tracks, the lower butt engaging surfaces do not form a smooth transition. There are no continual butt engaging surfaces at the juncture of the upper raising cam member and upper stitch cam member. When the stitch cam is moved to change the stitch forming level of the needles, the spacing between the downwardly inclined upper and lower butt engaging surfaces changes, and the downwardly inclined upper and lower butt engaging surfaces do not remain substantially parallel. As a result, the needles sometimes do not pass through the closed track as accurately as desired, and knitting quality may be compromised. During high speed knitting operation, the needle butts could jam as they move from the upper cam member onto the downwardly inclined butt engaging surface of the stitch cam member.

SUMMARY OF THE INVENTION

It is therefore an object of the present invention to provide a stitch cam unit having a stitch cam and lower landing cam member obliquely movable together to change the stitch forming level of the needles while maintaining a smooth transition between the various butt engaging surfaces of the raising and stitch cam members when the stitch forming level is changed.

It is another object of the present invention to provide a stitch cam unit for raising and lowering the needles which includes upwardly and downwardly inclined, closed tracks and a stitch cam member and lower landing cam member obliquely moveable together to change the stitch forming level of the needles while maintaining substantially parallel downwardly inclined upper and lower butt engaging surfaces.

In accordance with the present invention, a stitch cam unit for raising and lowering the needles includes a support body and needle raising cam means having upper and lower cam members fixed to the support body. Respective upper and lower cam members include corresponding upwardly inclined upper and lower butt engaging surfaces spaced from each other a distance substantially corresponding to the dimensions defining the predetermined height of the needle butts to define an upwardly inclined closed track. The upper cam member also includes a downwardly inclined lower butt engaging surface extending from the top portion of the upwardly inclined lower butt engaging surface for engaging the needle butts. The upwardly and downwardly inclined surfaces of the upper cam members forms an arcuate surface at their juncture.

Stitch cam means includes an upper stitch cam member having a downwardly inclined lower butt engaging surface cooperating with the downwardly inclined lower butt engaging surface of the needle raising cam means. A lower landing cam member has an upper butt engaging surface spaced from the lower butt engaging surface of the upper stitch cam member a distance substantially corresponding to the dimensions of the predetermined height of the needle butts to define a closed track therebetween.

The stitch cam means is supported for moveable adjustment along an inclined angle relative to the fixed needle raising cam means for obliquely moving together the upper stitch cam member and the lower landing cam member for changing the stitch forming level of the needles. In the preferred embodiment, the downwardly inclined lower butt engaging surface of the upper cam member includes a front notch and the downwardly inclined lower butt engaging surface of the upper stitch cam member includes a rear notch cooperating with the front notch to provide a continual butt engaging surface when the upper stitch cam member is moved obliquely. The cooperating surfaces of the upper stitch cam member and the upper needle raising cam member not only form a smooth transition for the needle butts when the stitch forming level of the needles is changed, but also ensures that the downwardly inclined upper and lower surfaces remain substantially parallel. Additionally, the upper butt engaging surface of the lower landing cam member includes a front notch and the downwardly inclined upper butt engaging surface of the lower cam member includes a rear notch cooperating with the front notch of the upper butt engaging surface to provide a continual butt engaging surface when the lower landing cam member is moved obliquely.

In the preferred embodiment, the upper and lower cam members of the needle raising cam means are integrally formed with a needle raising mounting block. The needle raising mounting block includes pins are received in mounting holes positioned on the support body to aid in retaining the needle raising mounting block in proper position onto the support body. The stitch cam member and lower landing cam member preferably are integrally formed with a stitch cam mounting block. The stitch cam mounting block includes a tongue slidably received in a groove positioned on the support body.

In the preferred embodiment, the support body includes an opening in the groove. A rotatable cam having a configuration of an archimedes spiral is supported in the opening. A fixed pin extends from the stitch cam mounting block and is operatively connected to the archimedes cam. As the archimedes cam is rotated, the stitch cam mounting block, having the upper stitch cam member and lower landing cam member integrally connected thereto, is moved along an inclined angle relative to the fixed needle raising mounting block.

DESCRIPTION OF THE DRAWINGS

Other objects and advantages will appear as the description proceeds when taken in connection with the accompanying drawings, in which.

DETAILED DESCRIPTION OF THE PREFERRED EMBODIMENT

Figure 1:
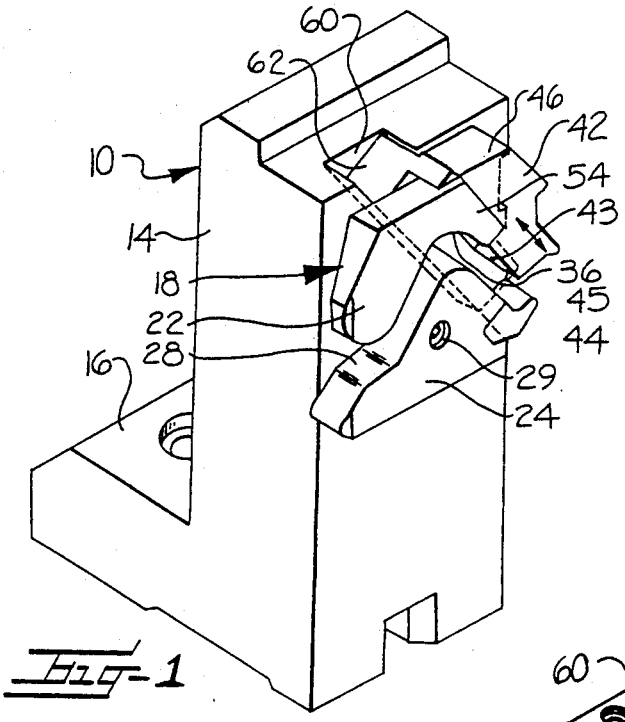
FIG. 1 is an isometric view of the support body having the needle raising mounting block and stitch cam mounting block connected thereto.
Figure 2:
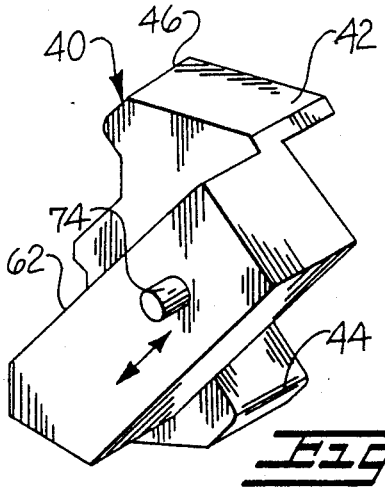
FIG. 2 is an enlarged isometric view of the stitch cam mounting block, removed from the support body and looking in the direction of the tongue, which is adapted to be received into the groove of the support body.
Figure 5:
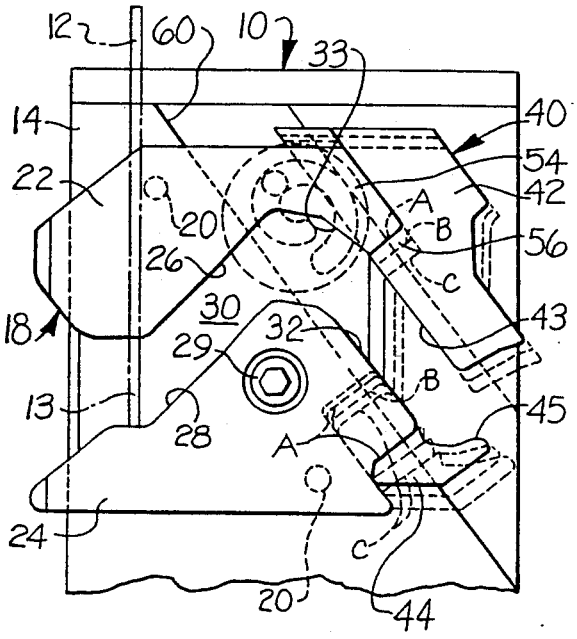
FIG. 5 is a fragmentary front elevation view of the upper end portion of the support body and showing needle raising and stitch cam mounting blocks supported thereon.
Figure 6:
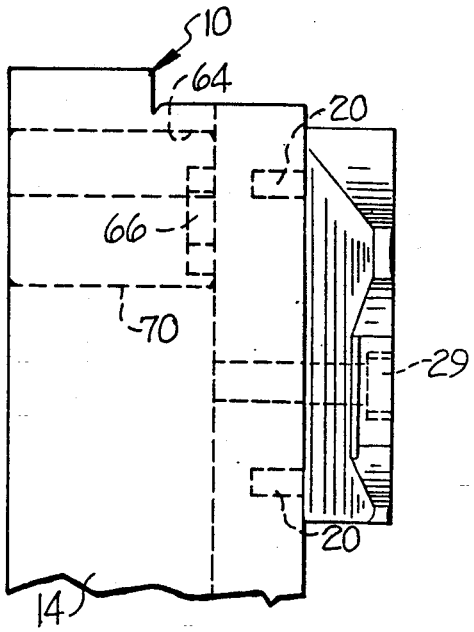
FIG. 6 is a side elevation view looking at the left-hand side of FIG. 5.
Figure 7:
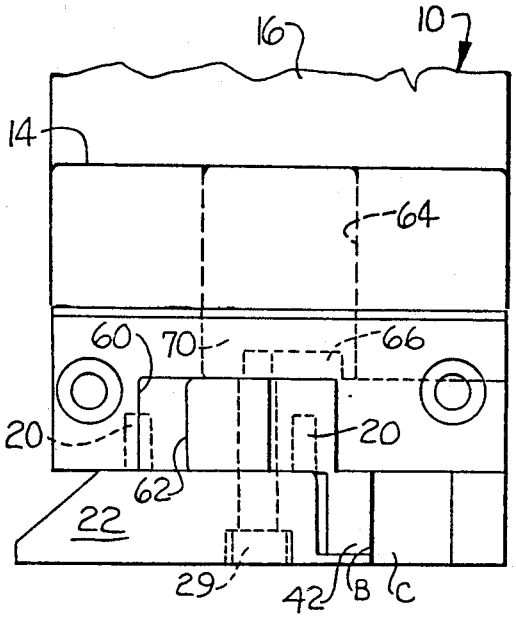
FIG. 7 is a plan view of FIG. 5.
Figure 8:
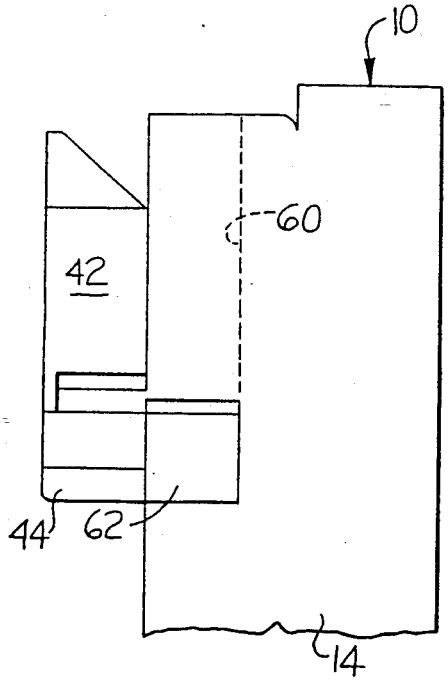
FIG. 8 is a side elevation view looking at the right-hand side of FIG. 5.

Referring now to the drawings, and more particularly to FIG. 1, there is disclosed generally at 10 a cam system in the form of an individual stitch cam unit for raising and lowering needles 12, shown in dash-dot lines in FIG. 5, by engaging the operating butts 13 of the needles in a circular knitting machine. In a knitting machine, a plurality of the stitch cam units 10 are positioned around the needle cylinder (not shown) and form a closed cam track for closely confining the operating butts 13 and for raising and lowering the needles 12 by engaging the upper and lower surfaces of the operating butts 13. A knitting machine is not illustrated. However, it is understood by those skilled in the art that the individual stitch cam units 10 are mounted on the bed plate of the knitting machine and adjusted to each other in a circular configuration around the needle cylinder.

As illustrated each stitch cam unit 10 includes a support body 14 having an inner or front face and a lower laterally extending rear support member 16. Retaining bolts (not shown) are inserted through openings in the rear support member 16 and are threaded into the bed plate (not shown) to retain the support body 14 on the knitting machine.

Figure 3:
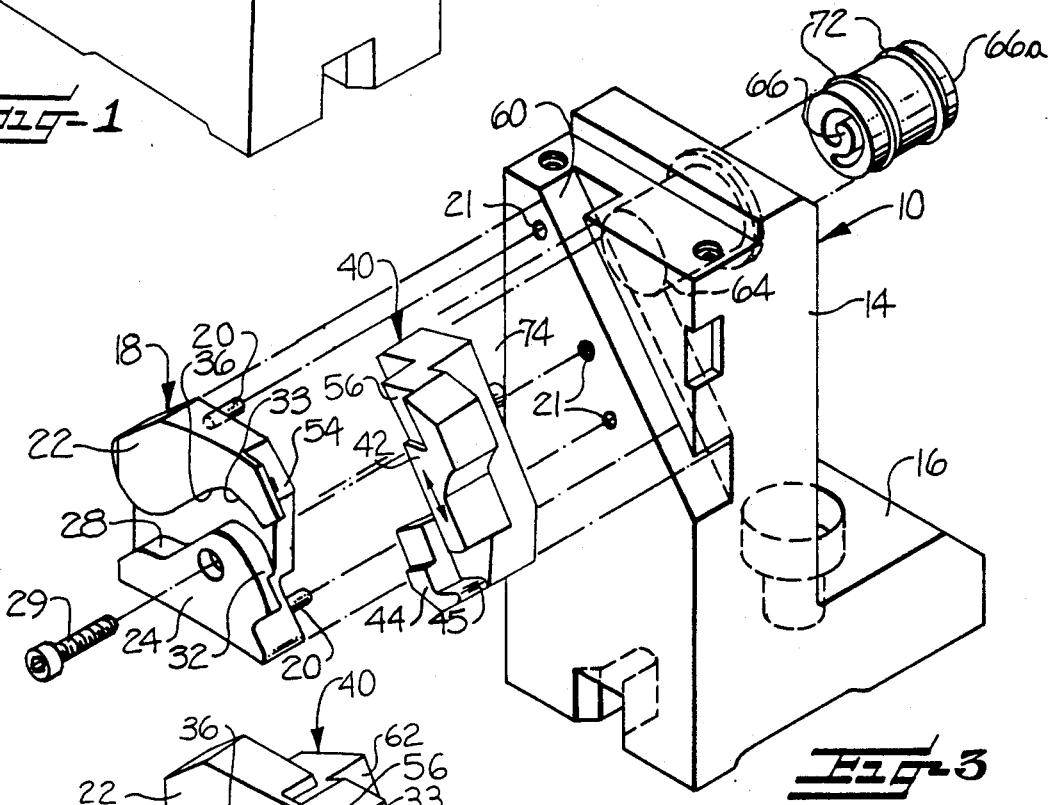
FIG. 3 is an exploded isometric view of the support body, mounting blocks and spiral configured rotatable cam.

Needle raising cam means, in the form of a needle raising mounting block, broadly indicated at 18, is fixed to the inner face of the support body 14 by mounting pins 20 received in mounting holes 21 extending into the front face of the support body 14 (FIG. 3). Upper and lower needle raising cam members 22 and 24 are integrally formed on the mounting block 18 and have corresponding upwardly inclined upper and lower butt engaging cam surfaces 26 and 28 which are spaced from each other a distance substantially corresponding to the dimensions of the predetermined height of the needle butts 13 to define an upwardly inclined needle raising closed track 30.

In the illustrated embodiment, the lower needle raising cam member 24 includes a hole through which a machine screw 29 is inserted for engaging a tapped hole in the support body 14 for securing the mounting block 18 to the support body 14 (FIG. 5). The lower needle raising cam member 24 also includes a downwardly inclined butt engaging upper surface 32 extending from the top portion of the upwardly inclined upper butt engaging surface 28 so as to form a substantially triangular configured upper surface (FIG. 5) for engaging the lower surface of the needle butt 13. The upper needle raising cam member includes a downwardly inclined lower butt engaging surface 33 extending from the top portion of the upwardly inclined lower butt engaging surface 26. The upwardly and downwardly inclined surfaces of the upper cam member form an arcuate surface 36 at their juncture.

As illustrated in FIGS. 1 and 3, stitch cam means, broadly indicated at 40, includes an upper stitch cam member 42 and a lower landing cam member 44. The members 42 and 44 are supported for movable adjustment along an inclined angle relative to the fixed needle raising mounting block 18 for obliquely moving together the stitch cam 42 and landing cam 44 and to thereby change the stitch forming level of the needles 12. Both the upper stitch cam member 42 and the lower landing cam member 44 are integrally formed on a stitch cam mounting block 46.

The upper stitch cam member 42 includes a lower butt engaging surface 43 for engaging the upper surface of needle butt 13 (FIG. 5). The lower landing cam member 44 includes an upper butt engaging cam surface 45 aligned with the downwardly inclined upper butt engaging surface 32 of the lower cam member 24. The cam surface 45 is spaced from the lower butt engaging surface 43 of the upper stitch cam member 42 a distance substantially corresponding to the dimension of the predetermined height of the needle butt 13, thus defining a closed track therebetween.

Figure 4:
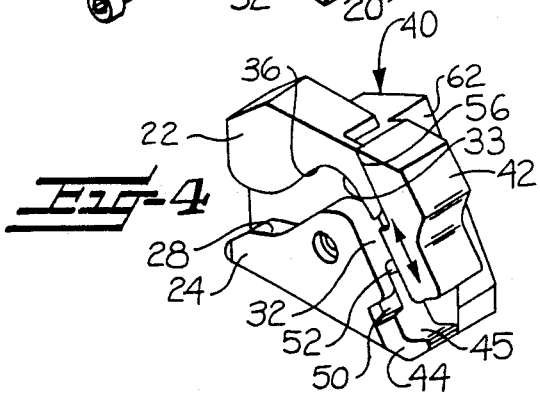
FIG. 4 is an isometric view of the mounting blocks removed from the support body and showing slidable engagement of the stitch cam mounting block on the needle raising mounting block.

As shown in FIG. 3, the stitch cam mounting block 46 is slidable along an oblique angle on the support block 14. The upper butt engaging surface 45 of the lower landing cam member 44 includes a front notch 50 cooperating with a rear notch 52 on the downwardly inclined upper butt engaging surface 32 of the lower cam member 24 to form a lap joint which provides a continual butt engaging surface when the lower landing cam member 44 is moved obliquely (FIG. 4). The lower butt engaging surface 26 of the upper cam member 22 includes a front extension 54 cooperating with a rear notch 56 on the downwardly inclined lower butt engaging surface 43 of the upper stitch cam member 42 to form a joint, which provides a continual butt engaging surface when the stitch cam member is moved.

The stitch cam mounting block 46 is supported for movable adjustment along an inclined angle relative to the fixed needle raising mounting block 18. Both the upper stitch cam member 42 and lower landing cam member 44 are integrally formed with the stitch cam mounting block 46 and move together to change the stitch forming level of the needle 12. As illustrated, an inclined groove 60 (FIG. 3) is positioned on the front face of the support body 14. A tongue 62 is positioned on the rear face of the stitch cam mounting block 46 and the tongue 62 is slidably received in the groove 60 for allowing the stitch cam mounting block 46 to move obliquely relative to the needle raising mounting block 18.

An opening 64 is positioned in the groove 60 near the top portion thereof (FIG. 3). A rotatable cam 66 having a configuration of an archimedes spiral is supported in the opening 64. The archimedes cam 66 is positioned in the inner end of a cylinder 70 rotatably mounted in the opening 64. Circumferential O-ring guide mounts 72 are supported in grooves on the cylinder 70 to aid in retaining the cylinder mount 70 within the opening 64 and preventing the archimedes cam cylinder 70 from moving laterally and longitudinally within the opening 64. The rear portion 66*a* of the archimedes cam includes a hex opening (not shown) for receiving an allen wrench for facilitating turning of the archimedes cam 66. As illustrated in FIG. 3, a pin 74 projects from the mounting block tongue 62. The outer end of the pin 74 is received in the archimedes cam 66. As the archimedes cam 66 is turned, the pin 74 is moved, thus forcing the stitch cam mounting block 46 either downward or upward in the inclined groove 60, depending on the directional rotation of the cam 66. The archimedes cam 66 provides a constant rate of change as the cam 66 is rotated. The pin 74 movement is constant and the pin and stitch cam mounting block 46 move in proportion to the amount the cam is turned.

As illustrated in FIG. 5, the stitch cam 42 and landing cam 45 are shown in solid lines in an upper angularly adjusted position, as indicated at A. Clockwise rotation of the cylinder 70 will move the pin 74 along the archimedes cam 64 and lower the stitch cam 42 and the landing cam 45 to the intermediate position, as indicated in dotted lines at B. Further rotation of the cylinder will position the stitch cam in the lowered position as indicated in dotted lines at C so that a longer stitch is drawn by the needle 12. Counter-clockwise rotation of the cylinder 70 will move the pin 74 along the archimedes cam 64 and raise the stitch cam 42 and the landing cam 45 to the upper position, as indicated in dotted lines at A, so that a short stitch is drawn by the needle 12. A locking screw (not shown) can be provided to hold the stitch cam mounting block in the adjusted position on the support body 14.

The upper and lower needle cam raising members 22, 24 define an upwardly inclined closed track 30 for ensuring that the needle butt 13 is closely confined and guided throughout upward movement along the closed cam track. This closed cam track 30 is continued on the downward inclined portion defined by the upper stitch cam member 42, the downwardly inclined surface 32 of the cam 24, and the lower landing cam member 44. As both the stitch cam member 42 and the landing cam member 44 are moved obliquely relative to the fixed needle raising mounting block 18, the dimensions of the closed track remain constant and no gaps in the cam track are created. Since the butt 13 of the needle 12 is closely confined during both the raising and lowering movement of the needle, harsh needle vibrations are not imported to the needle, as is the case in needle operating cam systems with open track camways. Also, the yarn feed fingers of the knitting machine do not have to be moved when the stitch cam is adjusted along an angular path, as is the case when stitch cams are vertically adjusted. The closed cam track also is better suited for high knitting machine operating speeds, i.e., retaining the needles in the track without undue movement. Additionally, the archimedes cam 66 provides a constant rate of change as the archimedes cam is turned. Thus, rotation of the archimedes cam is directly proportional to oblique movement of the stitch cam mounting block.

The cooperation of the upper cam member front extension 54 with the rear notch 56 on the downwardly inclined lower butt engaging surface 43 of the upper stitch cam member 42 provides for a smooth interface of the upper cam member and upper stitch cam member.

In the drawings and specification there has been set forth the best mode presently contemplated for the practice of the present invention, and although specific terms are employed they are used in a generic and descriptive sense only and not for purposes of limitation, the scope of the invention can be defined in the following claims.

That which is claimed is:

1. A stitch cam unit for engaging the operating butts of knitting needles in circular knitting machines to raise and lower the needles, comprising:

a support body having a groove formed therein at an oblique angle;

needle raising cam means fixed to said support body such that said needle raising cam means covers a portion of said groove, said needle raising cam means including:

an upper needle raising cam member having an upwardly inclined lower butt engaging surface extending between a bottom and a top portion;

a lower needle raising cam member having an upwardly inclined upper butt engaging surface extending between a bottom and a top portion;

said upwardly inclined lower butt engaging surface of said upper needle raising cam member and said upwardly inclined upper butt engaging surface of said lower needle raising cam member being spaced apart from each other to define an upwardly inclined first portion of closed track for receiving operating butts of knitting needles;

said upper needle raising cam member also including a downwardly inclined lower butt engaging surface extending from said top portion of said upwardly inclined lower butt engaging surface;

said lower needle raising cam member also including a downwardly inclined upper butt engaging surface extending from said top portion of said upwardly inclined upper butt engaging surface;

said downwardly inclined lower butt engaging surface of said upper needle raising cam member and said downwardly inclined upper butt engaging surface of said lower needle raising cam member being spaced apart from each other to define a downwardly inclined second portion of closed track for receiving operating butts of knitting needles; movable stitch cam means, including:

an upper stitch cam member having a lower butt engaging surface;

a lower landing stitch cam member having an upper butt engaging surface being spaced apart from said lower butt engaging surface of said upper stitch cam member to define a third portion of closed track for receiving operating butts of knitting needles; and a tongue being slidably received within said groove in said support block, a portion of said tongue extending behind said needle raising means to slidably retain said movable stitch cam means against said support body; and means for moving said stitch cam means obliquely relative to said fixed needle raising cam means;

said downwardly inclined lower butt engaging surface of said upper needle raising cam member including a front extension, and said downwardly inclined lower butt engaging surface of said upper stitch cam member including a notch, said front extension of said downwardly inclined lower butt engaging surface of said upper needle raising cam member and said notch of said downwardly inclined lower butt engaging surface of said upper stitch cam member cooperating with each other to provide a continual lower butt engaging surface when said stitch cam means is moved; and said upper butt engaging surface of said lower landing stitch cam member including a front notch, and said downwardly inclined upper butt engaging surface of said lower needle raising cam member including a rear notch, said notches of said landing stitch cam member and said downwardly inclined upper butt engaging surface of said lower needle raising cam member cooperating with each other to provide a continual upper butt engaging surface when said stitch cam means is moved;

whereby said track defined by said needle raising means and said movable stitch cam means remains closed when said movable stitch cam means is moved between different positions, and further whereby the stitch forming level of the needles as defined by said closed track may be adjusted without substantially narrowing or widening said closed cam track.

2. A stitch cam unit according to claim 1 wherein said means for slidably moving said movable stitch cam means within said groove includes an archimedes cam.

3. A stitch cam unit according to claim 2 wherein said means for slidably moving said movable stitch cam is a rotatable cylinder mounted in said support block, said cylinder having a groove defining said archimedes cam.

4. A stitch cam unit according to claim 3 wherein said rotatable cylinder is received within an opening in said support block which extends into said groove of said support block.

5. A stitch cam unit according to claim 4 further including a pin projecting from said tongue of said movable stitch cam means for engaging said groove defining said archimedes cam.

6. A stitch cam unit according to claim 5 further including a plurality of grooves formed around the periphery of said rotatable cylinder and a circumferential O-ring guide supported in each said peripheral groove to aid in retaining said cylinder within said opening in said support block.

7. A stitch cam unit according to claim 6 wherein said rotatable cylinder includes a hex opening for receiving an allen wrench.

8. A stitch cam unit according to claim 5 wherein said upper stitch cam member and said lower landing stitch cam member are integrally formed on a stitch cam mounting block.

9. A stitch cam unit according to claim 8 wherein said upper and lower needle raising cam members of said needle raising means are integrally formed on a needle raising mounting block.

10. A stitch cam unit according to claim 9 further including a releasable locking screw for holding said stitch cam mounting block in a selected position.

11. A stitch cam unit according to claim 1 wherein an arcuate surface is defined by the juncture of said upwardly inclined lower butt engaging surface of said upper needle raising cam member and said downwardly inclined lower butt engaging surface of said upper needle raising cam member.

12. A stitch cam unit according to claim 11 wherein an arcuate surface is defined by the juncture of said upwardly inclined upper butt engaging surface of said lower needle raising cam member and said downwardly inclined upper butt engaging surface of said lower needle raising cam member.

13. A stitch cam unit according to claim 9 further including a plurality of mounting holes defined by said support body and a plurality of mounting pins extending from said needle raising mounting block for being received within said mounting holes.

14. A stitch cam unit according to claim 13 further including a tapped hole in said support body, a screw hole in said needle raising mounting block for being positioned collinear with said tapped hole, and a machine screw extending through said screw hole and said tapped hole for securing said needle raising mounting block to said support body.

* * * * *